US007918457B2

(12) United States Patent
Wittevrongel

(10) Patent No.: US 7,918,457 B2
(45) Date of Patent: Apr. 5, 2011

(54) BALL-SHAPED PUZZLE

(75) Inventor: Marc Wittevrongel, Herenthout (BE)

(73) Assignee: DPT, Antwerp (BE)

( * ) Notice: Subject to any disclaimer, the term of this patent is extended or adjusted under 35 U.S.C. 154(b) by 81 days.

(21) Appl. No.: 11/817,213

(22) PCT Filed: Feb. 6, 2006

(86) PCT No.: PCT/EP2006/050698
§ 371 (c)(1),
(2), (4) Date: Nov. 10, 2008

(87) PCT Pub. No.: WO2006/089836
PCT Pub. Date: Aug. 31, 2006

(65) Prior Publication Data

US 2009/0230621 A1 Sep. 17, 2009

(30) Foreign Application Priority Data

Feb. 25, 2005 (BE) ..... 2005/0106
Apr. 22, 2005 (EP) ..... 05447086
Jan. 26, 2006 (EP) ..... 06100903

(51) Int. Cl.
*A63F 9/08* (2006.01)

(52) U.S. Cl. ..... 273/153 S

(58) Field of Classification Search ..... 273/153 R, 273/156, 153 S
See application file for complete search history.

(56) References Cited

U.S. PATENT DOCUMENTS

| | | | | | |
|---|---|---|---|---|---|
| 4,674,750 | A * | 6/1987 | Abu-Shumays et al. | .. | 273/153 S |
| 4,856,786 | A * | 8/1989 | Gyovai | ..... | 273/153 S |
| 4,865,323 | A * | 9/1989 | Heusinkveld | ..... | 273/153 S |
| 4,989,872 | A * | 2/1991 | Urrestarazu Borda | ..... | 273/153 S |
| 5,452,895 | A * | 9/1995 | Ray | ..... | 273/153 S |
| 5,566,941 | A * | 10/1996 | Destics | ..... | 273/153 S |
| 5,816,571 | A * | 10/1998 | Chen | ..... | 273/153 S |
| 5,836,584 | A * | 11/1998 | Chen | ..... | 273/153 S |
| 6,994,343 | B2 * | 2/2006 | Blazek et al. | ..... | 273/153 S |
| 7,547,019 | B2 * | 6/2009 | Chen | ..... | 273/153 S |
| 2005/0230908 | A1 * | 10/2005 | Perez et al. | ..... | 273/153 S |
| 2005/0269770 | A1 * | 12/2005 | Mak | ..... | 273/153 R |

FOREIGN PATENT DOCUMENTS

| | | | |
|---|---|---|---|
| FR | 2797195 | A1 | 2/2001 |
| WO | 9427694 | A1 | 12/1994 |

* cited by examiner

*Primary Examiner* — Steven Wong
(74) *Attorney, Agent, or Firm* — Browdy and Neimark, PLLC

(57) ABSTRACT

The invention relates to a ball-shaped puzzle comprising a spherical support element (1; 31) and a plurality of movable puzzle elements (16; 33) which all have substantially the same size and shape, the movable puzzle elements (16; 33) being slidably engaged in a trajectory (2; 32) on the outside of the spherical support element (1; 31), the trajectory (2; 32) defining a plurality of predetermined positions on the outside of the spherical support element (1; 31) between which the puzzle elements (16; 33) are movable. The spherical support element (1; 31) comprises a core and a plurality of trajectory forming elements (15; 45-46) which form the trajectory (2; 32), the trajectory forming elements (15; 45-46) being fixed onto the core (13; 43-44) by a snap-fitting arrangement (40-41).

12 Claims, 11 Drawing Sheets

BALL-SHAPED PUZZLE

TECHNICAL FIELD

The present invention relates to a ball-shaped puzzle according to the preamble of the first claim.

BACKGROUND ART

In FR-A-2797195 a ball-shaped puzzle is described of which the surface is composed of movable parts. The puzzle has the structure of a soccer ball with curved pentagon and hexagon elements. One of the hexagon elements is removable and the others are slidable along a trajectory. The pentagon elements can be depressed towards the inside of the puzzle to enable the hexagon elements to pass upon movement from one position on the trajectory to another.

Other ball-shaped puzzles are known from U.S. Pat. No. 5,566,941 and U.S. Pat. No. 4,889,340. These documents disclose puzzles whose outer surface is formed by two types of movable puzzle elements, which are movably assembled around a spherical core.

Because all these ball-shaped puzzles are three-dimensional objects with movable surface parts, they have relatively complex structures which are expensive to manufacture. Especially the assembly, which can only be done manually, is laborious and hence costly.

Another ball-shaped puzzle is known from WO-A-94/27694. The puzzle described herein comprises a spherical support member on which a trajectory is provided in which movable puzzle elements are engaged. It is not disclosed how the spherical support member and especially the trajectory in it are constructed.

DISCLOSURE OF THE INVENTION

It is an aim of the present invention to provide a ball-shaped puzzle which can be assembled more easily and can thus be manufactured at a reduced cost.

This aim is achieved according to the invention with a ball-shaped puzzle showing the technical characteristics of the characterising part of the first claim.

The ball-shaped puzzle of the invention comprises a spherical support element and a plurality of movable puzzle elements which all have substantially the same size and shape. The movable puzzle elements slidably engage in a trajectory on the outside of the spherical support element. The trajectory defines a plurality of positions between which the movable puzzle elements can be moved. The trajectory is formed in the spherical support element by a plurality of trajectory forming elements which are fixed onto a core of the spherical support element by a snap-fitting arrangement.

In assembling the puzzle of the invention, the trajectory forming elements and the movable puzzle elements are placed one by one around the core. As a result of the snap-fitting arrangement, this assemblage is simplified to a large extent. Each trajectory forming element is simply put into place by pushing it onto the core and the snap-fitting arrangement can prevent that the trajectory forming element comes loose again. The movable puzzle elements are placed along with the trajectory forming elements and are immediately held in place by them. As a result, there is substantially no risk that the puzzle falls apart again during assemblage.

In a preferred embodiment of the ball-shaped puzzle of the invention, the trajectory forming elements and the core are provided with orientation locking members, which have complementary shapes and are provided for fixing the orientation of the trajectory forming elements once fitted on the core. This can ensure that the trajectory forming elements are immediately fitted onto the core in the correct orientation, so that the assemblage can be further facilitated.

In a preferred embodiment of the ball-shaped puzzle of the invention, the snap-fitting arrangement comprises a pin on the trajectory forming elements and a complementary opening in the core for accommodating the pin.

In the above described embodiment, the core is preferably constructed as two matching halves, the openings in each of the halves all extending substantially in the same direction. This has the advantage that the core can be manufactured more cheaply, for example by injection of a plastic material in a suitable mould.

The fact that the openings in one halve of the core extend substantially in the same direction can imply—depending on the shape of the trajectory—that the shape of each trajectory forming elements is adapted to the opening to which it is to be fitted. This can limit the number of possible positions on the core where one of the trajectory forming elements can be fitted, so that assemblage can be further facilitated.

The movable puzzle elements themselves preferably comprise a top part for forming the outer surface of the puzzle and a bottom part for engaging in the trajectory, the top and bottom parts being fixed to each other by a second snap-fitting arrangement. This construction can reduce the manufacturing costs of the movable puzzle elements.

During the movement from one position to the other, the movable puzzle elements take up a given space. The movement is accommodated by the fact that the spherical support element is fully composed of parts which are fixed with respect to each other and which are all located outside the space taken up by the movable puzzle elements during movement. Because the spherical support element is fully located outside the space needed for movement of the movable puzzle elements, there is no need to move parts out of the way of the movable puzzle elements when these are slid from one position to another. As a result, the user only has to manipulate the movable puzzle element for moving it from one position to another, which is a lot easier with respect to one of the prior art puzzles. Furthermore, this has the advantage that the slidably mounted puzzle elements can become the only puzzle elements which are movably mounted on the spherical support element. There is no longer a need for elements which can be depressed for enabling the sliding of the movable puzzle elements. This can greatly reduce the complexity of the construction of the ball-shaped puzzle.

In a preferred embodiment of the ball-shaped puzzle of the invention, at least one of the movable puzzle elements is removably mounted on the puzzle to create an empty position and enable the other movable puzzle elements to be moved one by one for solving the puzzle. This removable puzzle element is replaced after the user has solved the puzzle, to fix the position of the other movable puzzle elements. Alternatively, the number of movable puzzle elements may also be less than the number of positions, so that always at least one empty position is present.

In a preferred embodiment of the ball-shaped puzzle of the invention, the plurality of positions which can be taken up by the movable puzzle elements is defined by the corners of a polyhedron, such as for example a dodecahedron, a tetradecahedron, an icosahedron, an icositetraheron, a triacontahedron, an icosidodecahedron, a hexecontahedron or other.

The outside surface of the ball-shaped puzzle of the invention may be substantially completely formed by movable puzzle elements. In other embodiments, the outside surface may be formed by a combination of fixed and movable puzzle elements. In this case, the movable puzzle elements and the fixed puzzle elements mainly extend in different, concentric spherical planes so that the fixed puzzle elements enable passage of the movable puzzle elements. The fixed puzzle elements may be countersunk with respect to the movable puzzle elements or vice versa. The fixed elements are preferably formed by top surfaces of the trajectory forming elements. Suitable shapes for the combination of fixed and movable puzzle elements are respectively for example: regular pentagons and regular hexagons (soccer ball), regular stars and regular hexagons, or any other combination of complementary shapes known to the person skilled in the art.

BRIEF DESCRIPTION OF THE DRAWINGS

The invention will be further elucidated by means of the following description and the appended figures.

MODES FOR CARRYING OUT THE INVENTION

Figure 1:
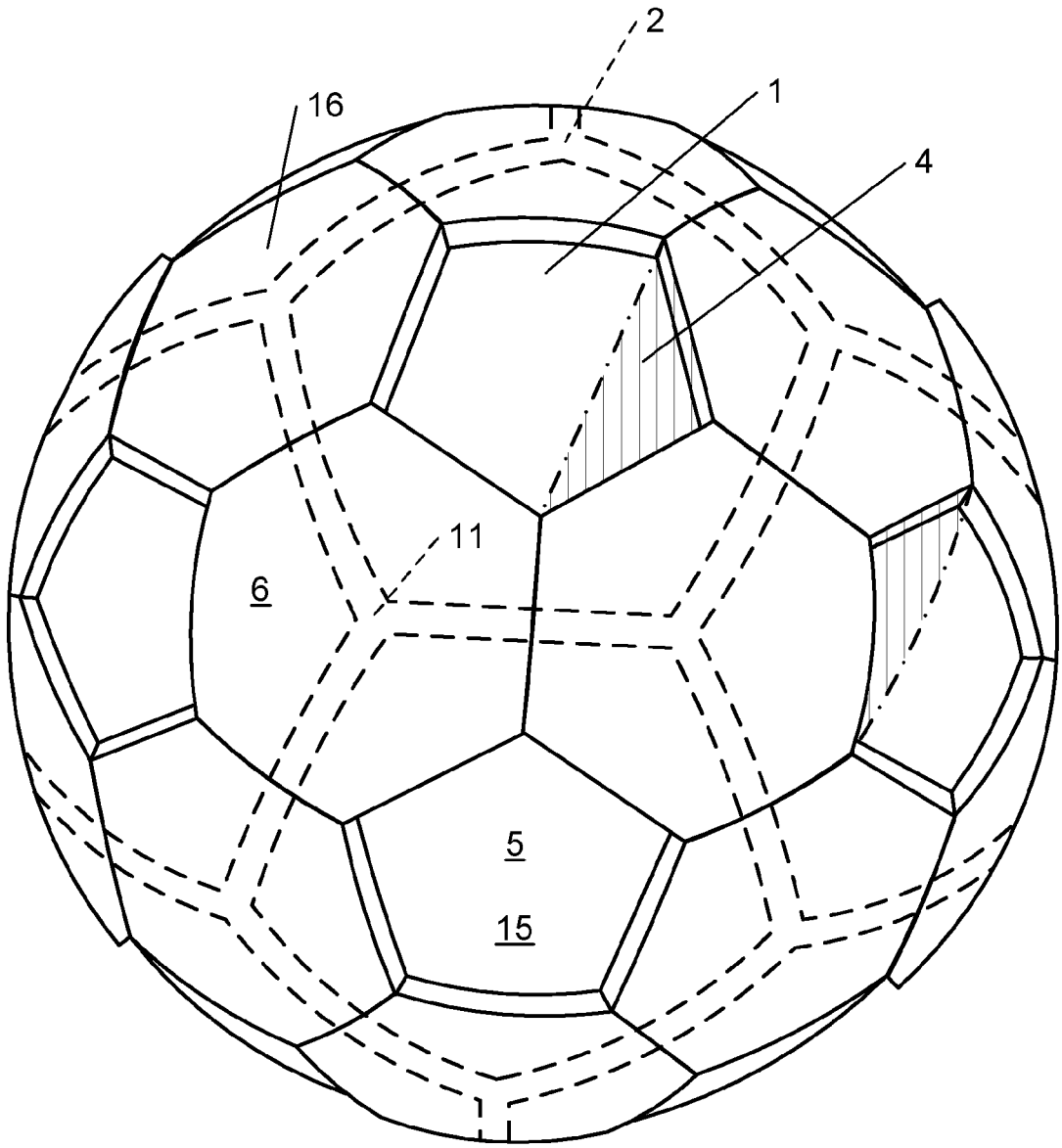
FIGS. 1 and 2 show perspective views of a first embodiment of a ball-shaped puzzle according to the invention.
Figure 2:
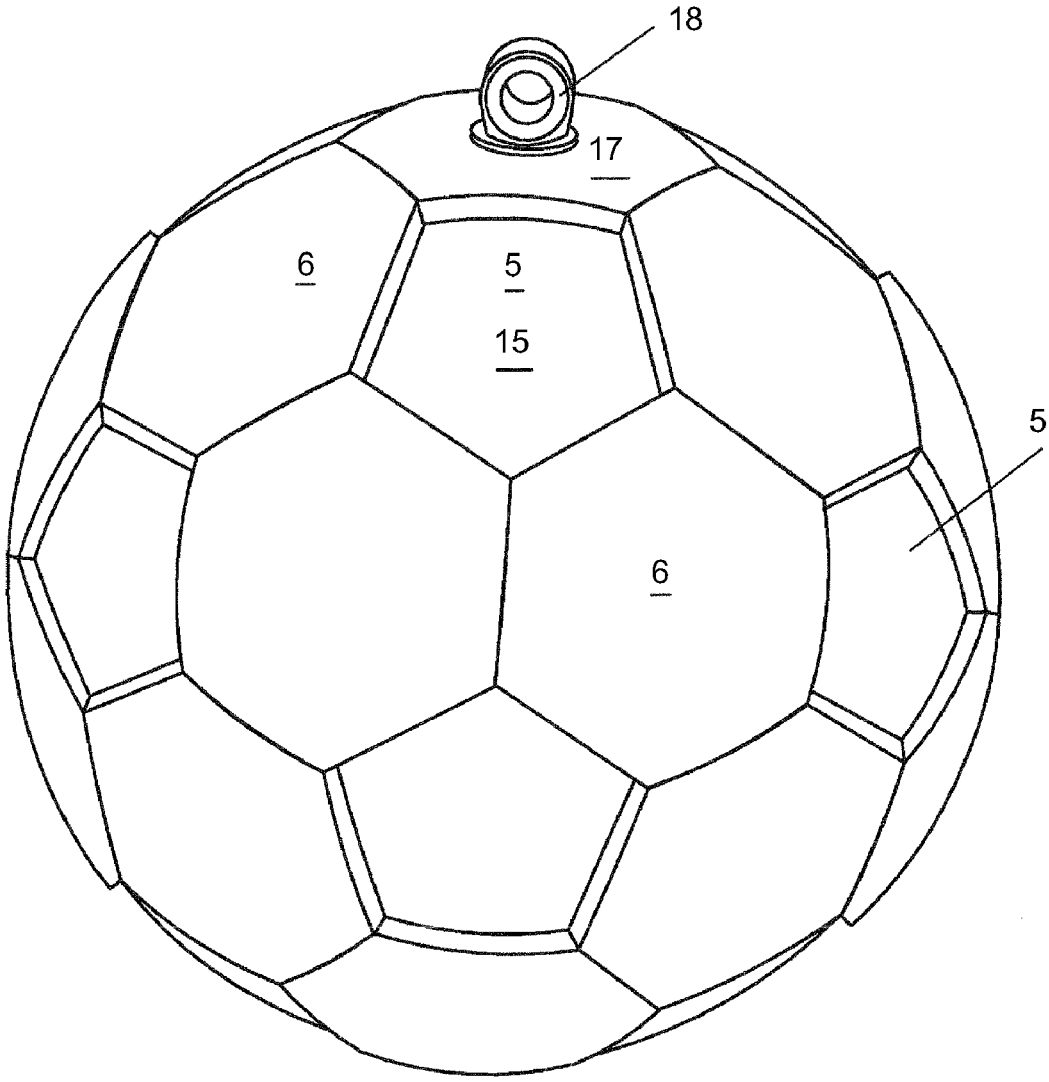

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

The term "comprising", used in the claims, should not be interpreted as being restricted to the means listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

The ball-shaped puzzles shown in the figures are ball-shaped and have an outer surface comprising movable parts, formed by the top faces of movable puzzle elements which are slidably mounted on a spherical support element. The combination of the shape of the movable puzzle elements and the way in which they are mounted on the outside of the spherical support element makes it possible to move the puzzle elements without being disengaged from the spherical support element. The outer surface of the puzzle is provided with an image of any kind, which can be assembled by the user by sliding the movable parts. Due to the three-dimensional structure of the puzzles and the fact that the movable parts are slidable in multiple directions, the puzzles can have a high complexity.

The ball-shaped puzzle of FIGS. 1-6 comprises a spherical support element 1 in the outside of which a trajectory 2 is provided. A plurality of movable puzzle elements 16, which all have substantially the same size and shape, are slidably mounted in the trajectory 2 on the outside of the spherical support element 1. Thus, the movable puzzle elements 16 are movable between a plurality of positions on the outside of the spherical support element. During movement between any two of these positions, the movable puzzle elements take up a given space, which is defined by their shape and size. The space for the movement between two adjacent positions is indicated in FIG. 1 by the shaded area 4. Therefore, so as not to hamper this movement, the spherical support element 1 is fully composed of parts which are fixed with respect to each other and which are all located outside this space.

The ball-shaped puzzle of FIGS. 1-6 looks a lot like a soccer ball, or—in mathematical terms—a truncated icosahedron drawn on a sphere. The outside of the puzzle is made up of twenty hexagonal elements 6 and twelve pentagonal elements 5. The hexagonal elements 6 are formed by the top parts of the movable puzzle elements 16 and the pentagonal elements 5 are formed by uncovered parts of the outside surface of the spherical support element 1. Among the twenty hexagonal elements 6, one 17 is removably mounted, for example by means of a screw 18, so that a vacant position is created which can be used for sliding the other hexagonal elements 6 one by one in an effort to solve the puzzle. The trajectory 2, which is shown in broken lines, has the shape of a dodecahedron to guide the hexagonal elements 6 one by one from their original position to the vacant position. The positions of the hexagonal elements 6 correspond to the corners 11 of the dodecahedron. As a result, each of the hexagonal elements 6 can be moved in three different directions and the vacant position can be filled by one of three different hexagonal elements 6. This adds to the complexity of solving the puzzle.

The ball-shaped puzzle of FIGS. 1-6 comprises a spherical support element 2 which is composed of multiple parts: a core 13 (FIG. 3) on which a number of trajectory forming elements 15 are fixed by means of a snap-fitting arrangement, such as for example the one which will be described below for the second embodiment of FIGS. 7-15. These trajectory forming elements 15 are shaped such that they slidably hold the movable puzzle elements 16 on the outside of the puzzle. The trajectory forming elements 15 all have a pentagonal shape and the movable puzzle elements 16 all have a hexagonal shape.

The hexagonal element 17 is removably mounted by means of for example a screw 18, so that a vacant position can be created which can be used for sliding the other hexagonal elements 16 one by one in an effort to solve the puzzle. After the puzzle has been solved, the hexagonal element 17 can be replaced for holding the other hexagonal elements 16 in place.

Figure 3:
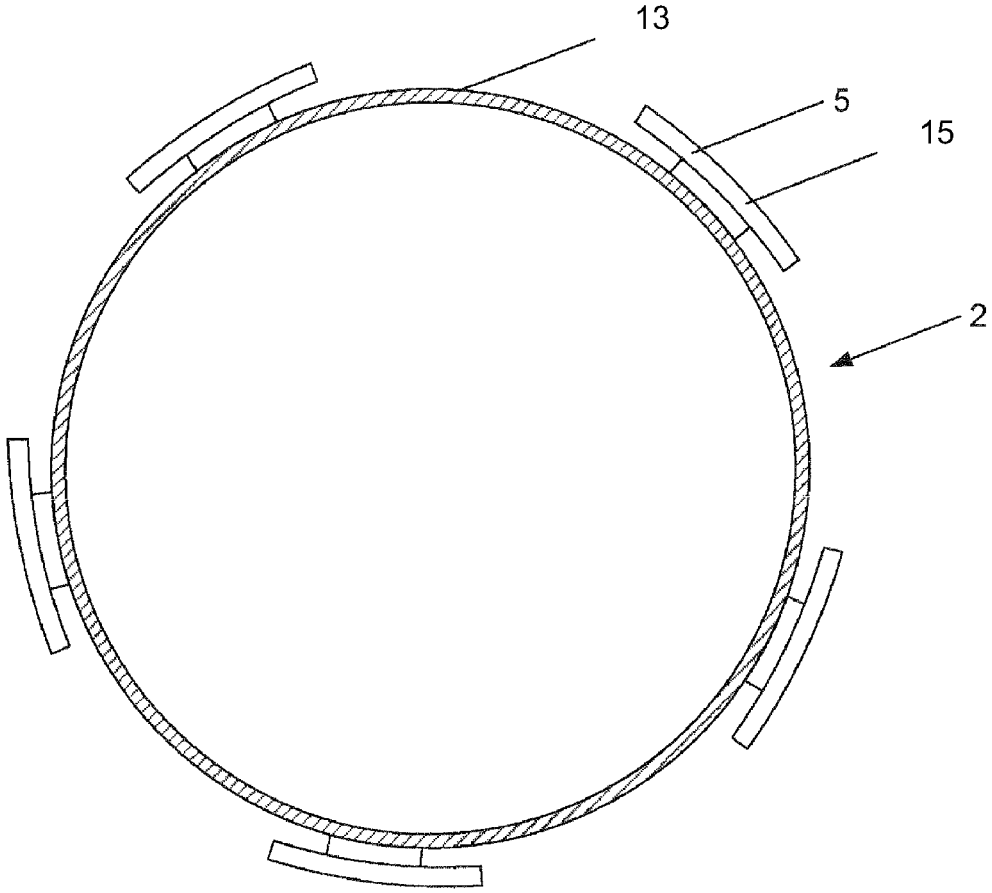
FIG. 3 shows a cross-section of the spherical support element of the first embodiment.
Figure 6:
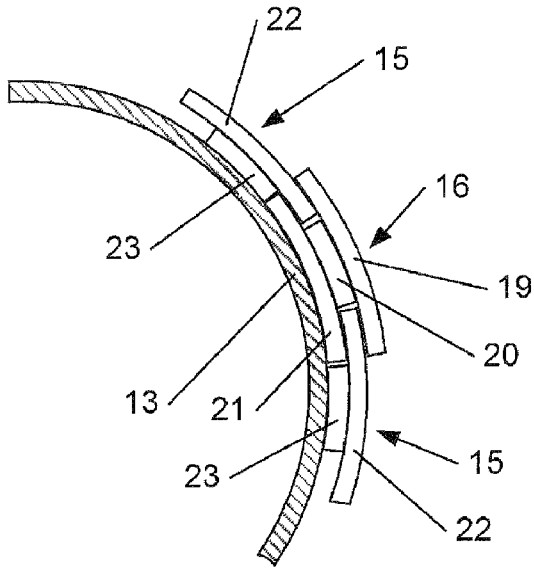
FIG. 6 shows a cross-section of part of the first embodiment.
Figure 4A:
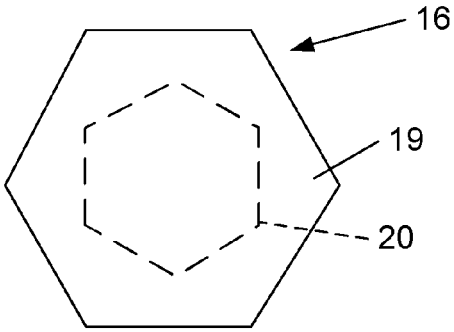
FIG. 4 shows a cross-section, a perspective view and a top view of one of the movable puzzle elements of the first embodiment.
Figure 4B:
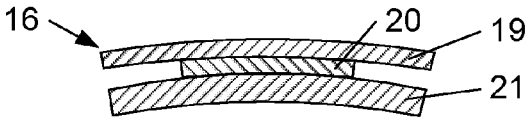
Figure 4C:
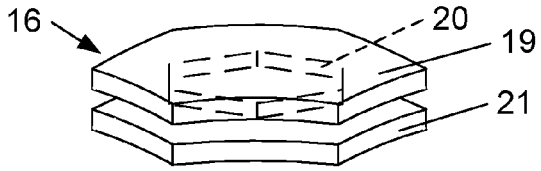

FIG. 4 shows one of the movable, hexagonal puzzle elements 16 of this first embodiment of the puzzle of the invention. The hexagonal element 16 has a bent shape and is slightly concave to facilitate the sliding over the outer surface of the spherical support element 1. It has a layered structure comprising a larger top layer 19, a smaller intermediate layer 20 and a larger bottom layer 21. The intermediate layer 20 is shaped such that the hexagonal element 16 can pass in between each two trajectory forming elements 15, which protrude on the outside of the spherical support element 1 as shown in FIG. 3. The top and bottom layers 19, 21 have hexagonal shapes of virtually the same size and orientation. The intermediate layer 20 also has a hexagonal shape, rotated 90° with respect to that of the top layer 19. The width of the intermediate layer 20 corresponds to the shortest distance between two trajectory forming elements 15, so that it can pass in between them. By this shape, the intermediate layer 20 has three pairs of parallel guides, formed by the sides of the hexagonal shape, each pair being oriented according to one of the sliding directions of the hexagonal element 16. This construction functions to prevent that the hexagonal element can be rotated about its height axis when it is moved from one position to the other, which can add to the complexity of solving the puzzle: the user has to slide the hexagonal element 16 around a pentagonal element 15 in order to turn it 60° to the left or to the right. Alternatively, the intermediate layer 20 could also be circular, which would enable rotation of the hexagonal element about its height axis. The layers 19-21 of the hexagonal element 16 can be attached to each other by bonding, gluing or by means of a snap-fitting arrangement such as will be described for the movable puzzle elements of the second embodiment below, or by any other means known to the person skilled in the art. The hexagonal elements 16 can also be single-piece moulded bodies.

The pentagonal trajectory forming elements 15 are bent in substantially the same way as the hexagonal movable puzzle elements 16. They have a layered structure which fits into that of the hexagonal elements 16 (see FIG. 6) and comprises a larger top layer 22 and a smaller bottom layer 23. Both layers have pentagonal shapes, but are inverted with respect to each other, so that the bottom layer 23 forms guides for the hexagonal elements 16.

Figure 5A:
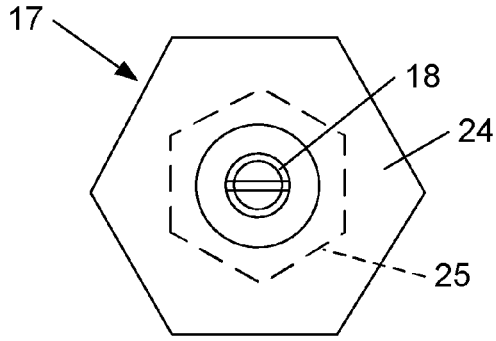
FIG. 5 shows a top view, a cross-section and a perspective view of the removable puzzle element of the first embodiment.
Figure 5B:
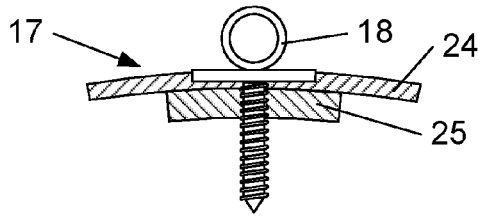
Figure 5C:
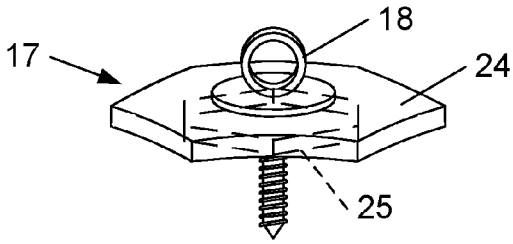

The removable hexagonal element 17 is shown in detail in FIG. 5. It is bent in substantially the same way as the hexagonal movable puzzle elements 16 and comprises a larger top layer 24 and a smaller bottom layer 25. The thickness of the bottom layer 25 equals substantially the sum of those of the intermediate and bottom layers 20, 21 of the other hexagonal elements 16. The screw 18 has a special shape with an eye, giving the ball-shaped puzzle the additional function of a key-ring. This eye also facilitates manual placement or removal of the removable element 17. Possibly a tensioning roundel can be provided to prevent the screw from coming loose.

The puzzle of FIGS. 1-6 can for example be assembled by first fixing eleven of the twelve pentagonal trajectory forming elements 15, then mounting the hexagonal elements 16 (which are held on the puzzle by the pentagonal elements 15), then fixing the final pentagonal element 15 and finally placing the removable element 17. For enabling the final placing of the removable element, a threaded hole (not shown) is provided in the centre of each of the positions for the hexagonal elements 16.

In the first embodiment shown in FIGS. 1-6, the hexagonal elements are shaped such that a rotation about their height axis is prevented. In alternative embodiments, they can also be shaped to allow this rotation, which would enable the user to rotate the hexagonal elements when being moved from one position to the other and would simplify the solving of the puzzle.

The second embodiment of the ball-shaped puzzle, shown in FIGS. 7-15, likewise comprises a spherical support element 31 in the outside of which a trajectory 32 is provided. A plurality of movable puzzle elements 33, which all have substantially the same size and shape, are slidably mounted in the trajectory 32 on the outside of the spherical support element 31. Thus, the movable puzzle elements 33 are movable between a plurality of positions on the outside of the spherical support element. In this second embodiment, the movable puzzle elements 33 have triangular shapes and cover substantially the whole outer surface of the puzzle. The underlying spherical support element 31 is substantially completely covered when the removable puzzle element 34 is in place.

The ball-shaped puzzle of FIGS. 7-15 has—in mathematical terms—the shape of an icosahedron drawn on a sphere. The outside of the puzzle is made up of twenty triangular elements 33. Among the twenty triangular elements 33, one 34 is removably mounted, so that a vacant position is created which can be used for sliding the other triangular elements 33 one by one in an effort to solve the puzzle. The trajectory 32 has the shape of a dodecahedron to guide the triangular elements 33 one by one from their original position to the vacant position. The positions of the triangular elements 33 correspond to the corners of the dodecahedron. As a result, each of the triangular elements 33 can be moved in three different directions and the vacant position can be filled by one of three different triangular elements 33. This adds to the complexity of solving the puzzle.

The second embodiment of the ball-shaped puzzle, shown in FIGS. 7-15, comprises a spherical support element 32 which is composed of multiple parts: a core in two halves 43, 44 on which a number of trajectory forming elements 45, 46 are fixed by means of a snap-fitting arrangement 40-41. These trajectory forming elements 45, 46 are shaped such that they slidably hold the movable puzzle elements 33 on the outside of the puzzle. The trajectory forming elements 45, 46 all have a pentagonal shape.

Figure 15:
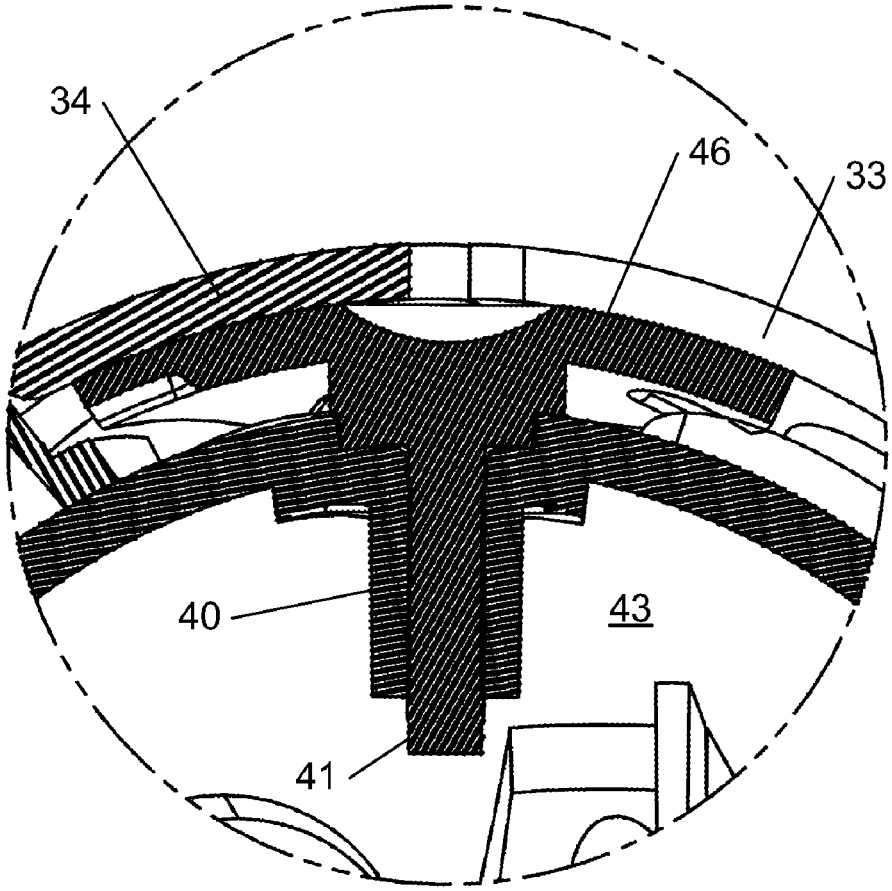
FIG. 15 shows an enlarged view of part XV of FIG. 11.

The snap-fitting arrangement which fixes the trajectory forming elements 45, 46 on the core 43, 44 comprises a fixing member 41, one on each trajectory forming element 45, 46, and a complementary opening 40 in the core for receiving the fixing member 41. As shown in the detail of FIG. 15, the fixing member 41 extends throughout the opening 40. The tip of the fixing member 41, which protrudes into the interior of the core 43, 44, has a small annular rim for ensuring the snap-fit. The snap-fitting arrangement for fixing the trajectory forming elements 45, 46 onto the core 43, 44 may also be carried out in any other manner known to the person skilled in the art.

The triangular element 34 is removably mounted so that a vacant position can be created which can be used for sliding the other triangular elements 33 one by one in an effort to solve the puzzle. After the puzzle has been solved, the triangular element 34 can be replaced for holding the other triangular elements 33 in place.

Each of the triangular elements 33 of this second embodiment of the invention has a bent shape and is slightly concave to facilitate the sliding over the outer surface of the spherical support element 31. It comprises a triangular top part 49 which snap-fits onto a bottom part 50, shaped for engaging in the trajectory 32. The whole is narrower in the middle, so that the triangular element 33 can pass in between each two trajectory forming elements 45, 46, which protrude on the outside of the spherical support element 31. The bottom part 50 is circular, which enables the triangular puzzle element 33 to be rotated about its height axis when it is moved from one position to the other. In other words, the triangular elements 33 are shaped such that a rotation about their height axis is enabled when they are moved from one position to the other. In alternative embodiments, they can also be shaped to prevent such a rotation, which would make the solving of the puzzle more complex.

Figure 13:
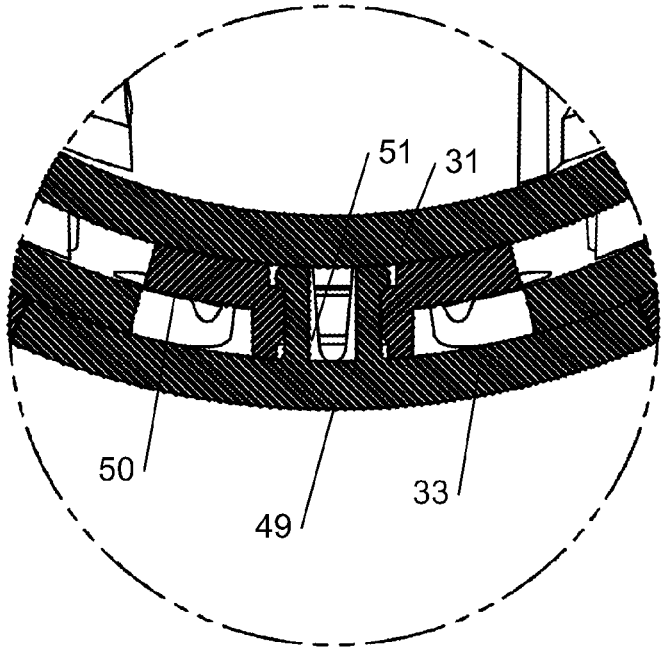
FIG. 13 shows an enlarged view of part XIII of FIG. 12.

As mentioned above, the top and bottom parts 49, 50 of the triangular elements 33 are fixed to each other by a snap-fitting arrangement. This arrangement is shown in FIG. 13: the top part 49 has an inwardly protruding resilient pin 51 which engages in an opening 52 in the bottom part 50. This snap-fitting arrangement can save manufacturing costs of the puzzle, since the top and bottom parts 49, 50 are easier to mould than a single-piece construction. In alternative embodiments, the triangular elements 33 could also be constructed as layers which are glued or bonded onto each other, or as single-piece moulded bodies.

The core of the spherical element 31 is formed by an upper core halve 43 and a lower core halve 44, which are connectable to each other by means of complementary connecting members 47, 48, which also snap-fit onto each other to facilitate assembly. These connecting members 47, 48 extend in the same direction, namely vertically in FIGS. 9 and 10, for reasons of obtaining a cost-efficient mouldable construction. For the same reason, the openings 40 in the core halves 43, 44, which are provided for accommodating fixing members 41 of the pentagonal trajectory forming elements 45, 46 also extend in this vertical direction. As a result of this vertical orientation, the top and bottom trajectory forming elements 46 differ from the others 45, which is clearly shown in FIGS. 9 and 11. This implies that the shape of the trajectory forming elements 45, 46 limits the positions where they can be mounted on the core, which can be advantageous for assemblage.

The fixing members 41 of the trajectory forming elements 45, 46 snap-fit into the openings 40 of the core. This strongly facilitates assemblage of the puzzle: there is no need for screwing parts together and since their position is immediately fixed, the risk that the puzzle falls apart again is severely reduced. In order to fix the orientation immediately, orientation locking shapes 42 are provided on the fixing members 41 and the openings 40.

The top parts of the pentagonal trajectory forming elements 45, 46 are bent to obtain the spherical outer surface of the spherical support element 31. Once assembled, they fit into the triangular elements 33 (see FIGS. 11-15).

Figure 14:
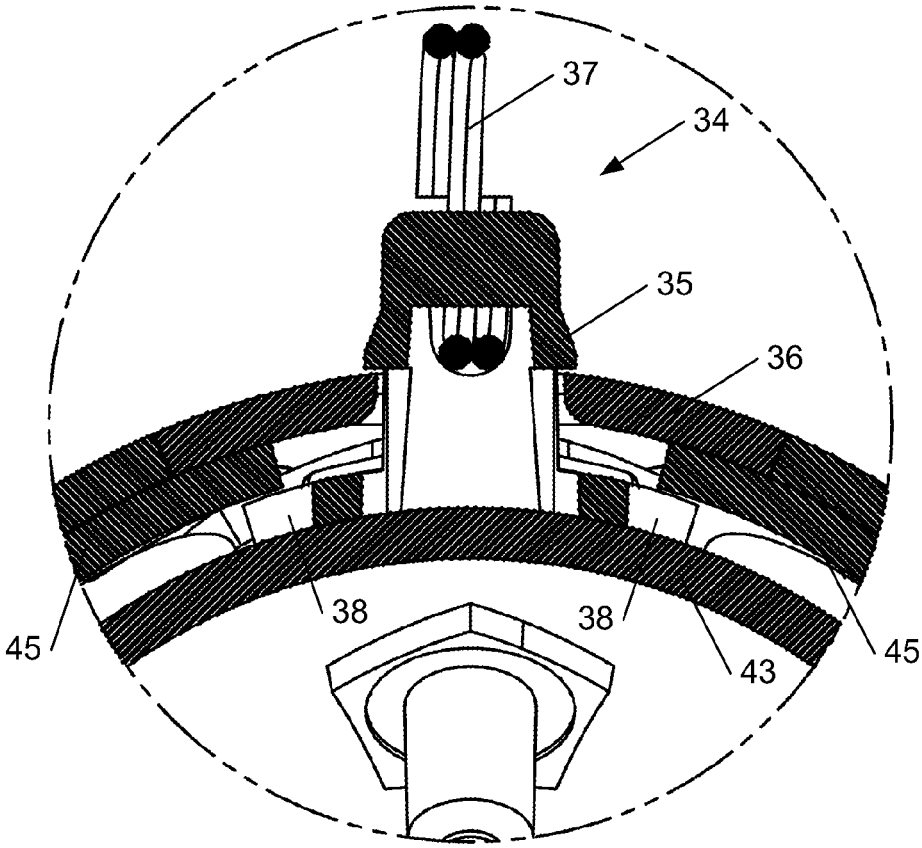
FIG. 14 shows an enlarged view of part XIV of FIG. 12.

The removable triangular element 34, which is shown in detail in FIG. 14, is composed of three parts: a support member 35, a triangular part 36 which forms part of the spherical surface of the puzzle and a key-ring 37. The support member 35 extends through a hole in the triangular part 36 and has an opening for receiving the key-ring 37. The support member 35 has three legs which can be rotated by means of the key-ring 37 to lock/unlock the removable element 34 on/from the puzzle. When locked, the three legs are rotated underneath the adjacent trajectory forming elements 45, 46.

The puzzle of FIGS. 7-15 can for example be assembled as follows. First, the two core halves 43, 44 are snap-fitted onto each other. Then, the trajectory forming elements 45, 46 are snap-fitted one by one onto the core 43, 44, placing the triangular elements 33 along with them by first placing the bottom parts 50 and then snap-fitting the top parts 49 onto the bottom parts 50. Finally the removable element 34 is placed in the position which remains vacant and its support member 35 is rotated to lock it.

Alternatively, the puzzle can also be assembled as follows. First, the two core halves 43, 44 are snap-fitted onto each other. Then, all 10 trajectory forming elements 45 and one of the top/bottom trajectory forming elements 46 are snap-fitted onto the core 43, 44. Then, the triangular elements 33 are inserted one by one and moved out of the way for vacating the space for the next one, until all positions of the puzzle are occupied except the five around the not yet mounted top/bottom trajectory forming element 46. Next, the four bottom parts 50 of the last four triangular puzzle elements 33 are placed and the top/bottom trajectory forming element is fitted. Finally, the top parts 49 of the last four triangular puzzle elements 33 are snap-fitted onto their bottom parts 50 and the removable triangular element is placed in the remaining position.

In summary, there are three snap-fitting arrangements in the second embodiment of FIGS. 7-15: a first fixing the trajectory forming elements 45 onto the core, a second fixing the top and bottom parts 49, 50 of the movable puzzle elements 33 onto each other and a third fixing the core halves 43 and 44 onto each other. Each of these snap-fitting arrangements facilitates the construction of the parts of the puzzle by moulding a plastic material and/or the assemblage of the puzzle, reducing the manufacturing costs of the puzzle.

Figure 7:
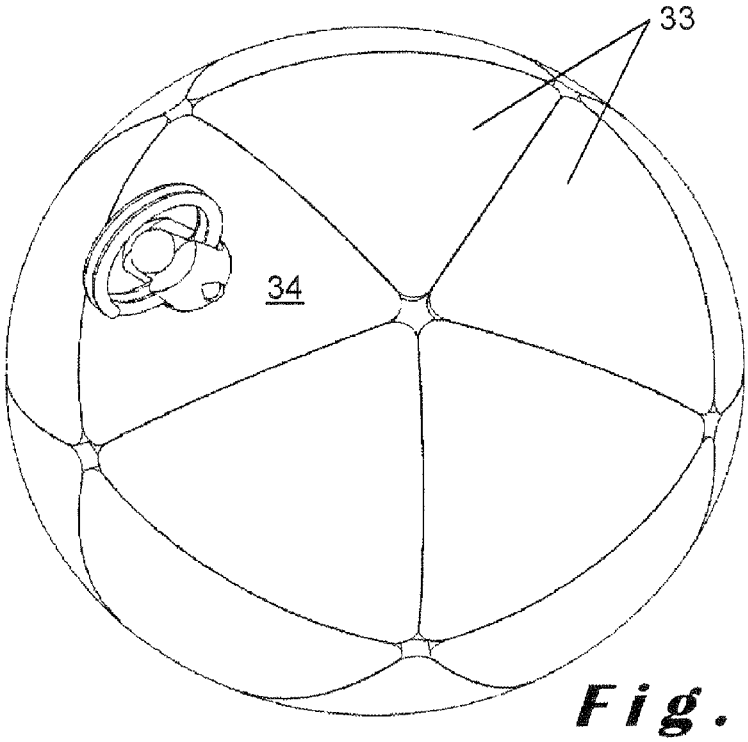
FIGS. 7 and 8 show perspective views of a second embodiment of a ball-shaped puzzle according to the invention.
Figure 8:
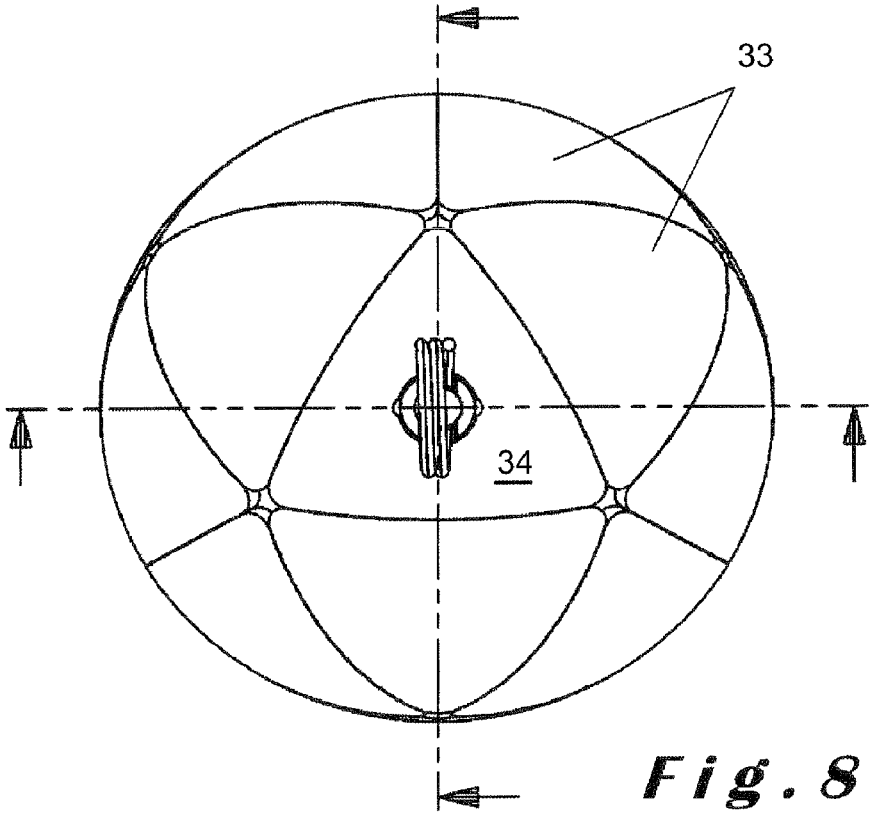
Figure 9:
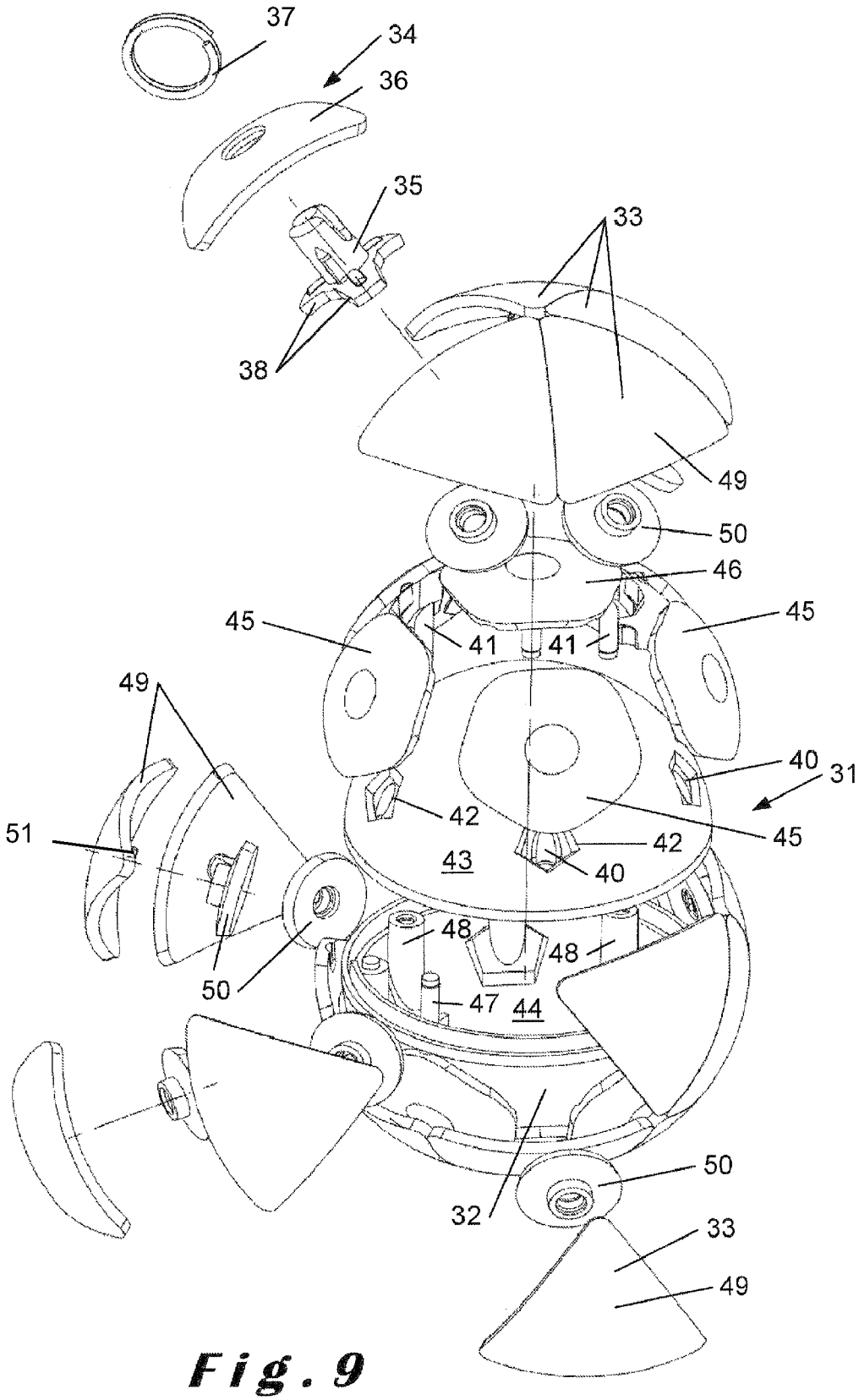
FIG. 9 shows an exploded view of the second embodiment.
Figure 10:
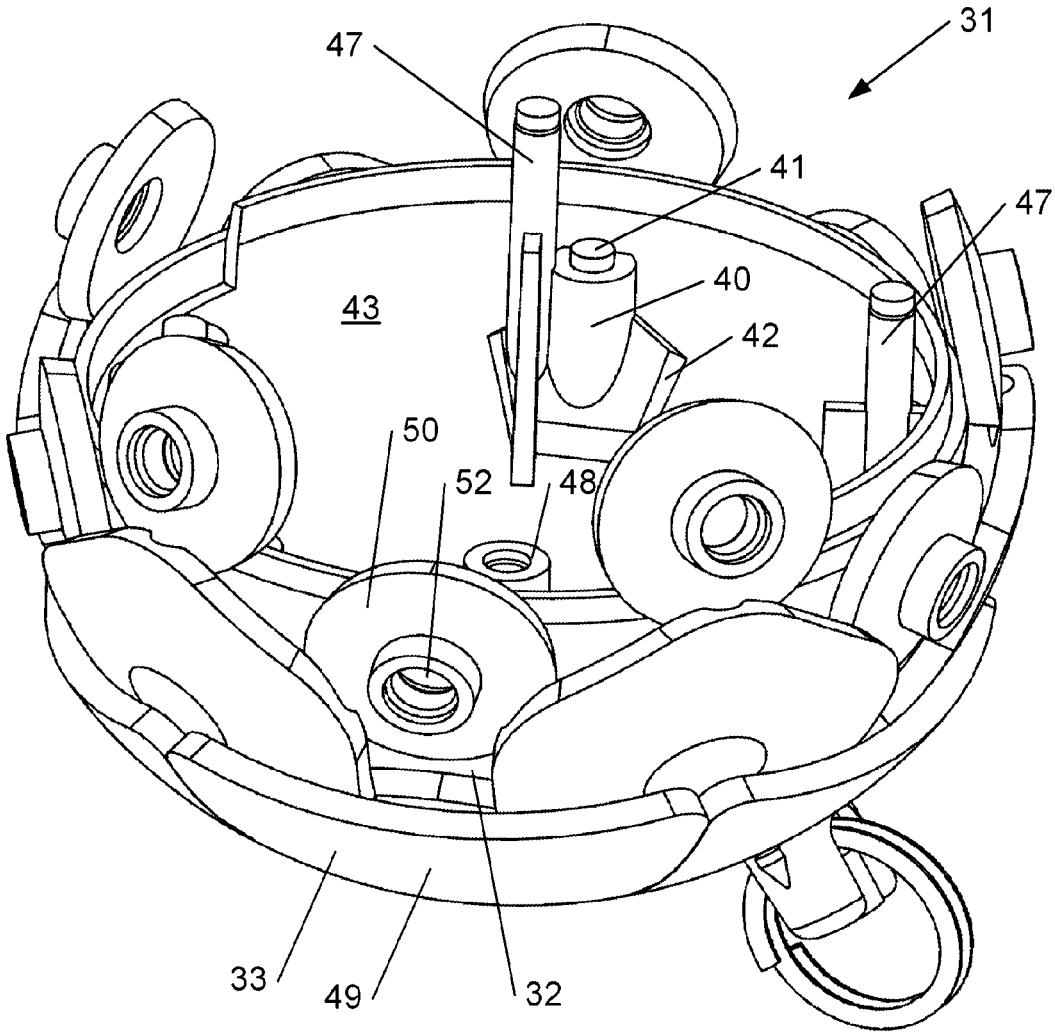
FIG. 10 shows the upper half of the second embodiment.
Figure 11:
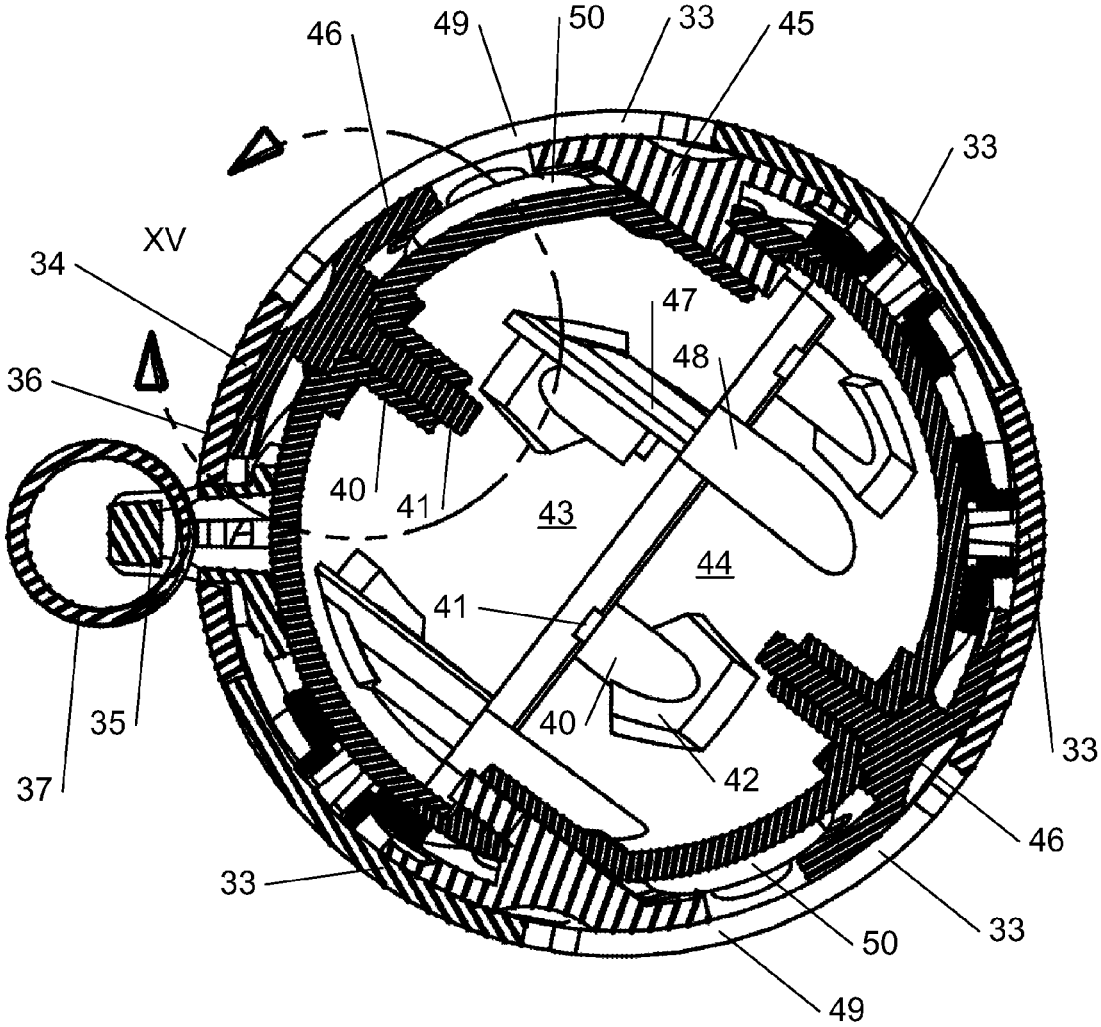
FIG. 11 shows a cross-section of the second embodiment, taken along the line XI-XI of FIG. 8.
Figure 12:
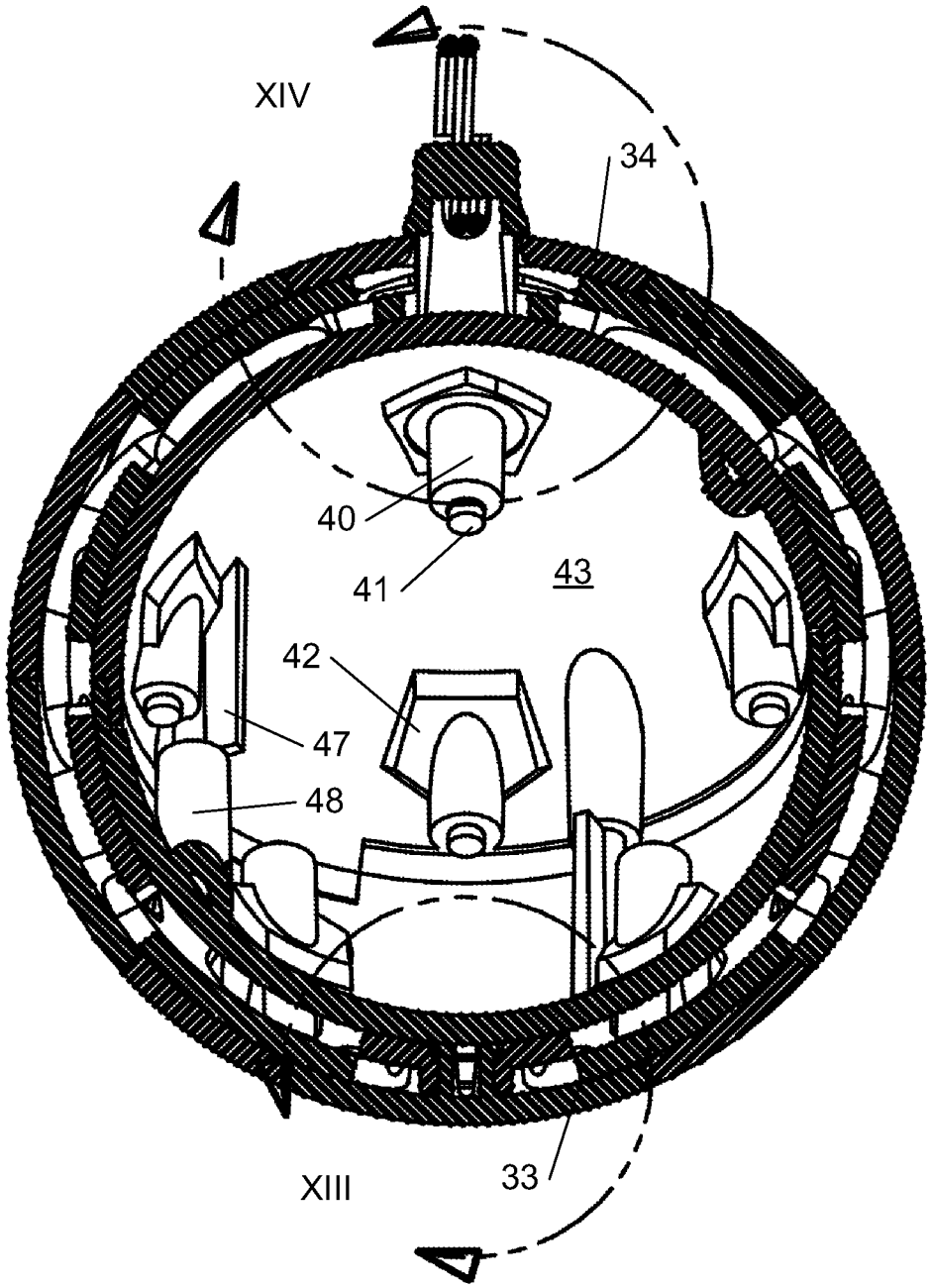
FIG. 12 shows a cross-section of the second embodiment, taken along the line XII-XII of FIG. 8.

The ball-shaped puzzles of FIGS. 1 and 7 each time have one removable element. In alternative embodiments, there can be no removable element (meaning there is always one vacant position) or there can be more than one removable element for facilitating solving of the puzzle (the user then has more possibilities for sliding puzzle elements).

REFERENCE LIST

1 spherical support element
2 trajectory
3
4 shaded area
5 pentagonal elements
6 hexagonal elements
7 -
8 -
9 -
10 -
11 crossings
12 -
13 core
14 -
15 trajectory forming elements
16 movable puzzle elements
17 removable hexagonal element
18 screw
19 top layer
20 intermediate layer
21 bottom layer
22 top layer

23 bottom layer
24 top layer
25 bottom layer
26 -
27 -
28 -
29 -
30 -
31 spherical support element
32 trajectory
33 movable triangular puzzle element
34 removable triangular puzzle element
35 support member
36 triangular part
37 key-ring
38 legs
39 -
40 openings
41 fixing member
42 orientation locking shapes
43 upper core halve
44 lower core halve
45 trajectory forming elements
46 top/bottom trajectory forming element
47 connecting member
48 connecting member
49 top part
50 bottom part
51 resilient pin
52 opening

The invention claimed is:

1. Ball-shaped puzzle comprising a spherical support element (1; 31) and a plurality of movable puzzle elements (16; 33) which all have substantially the same size and shape, the movable puzzle elements (16; 33) being slidably engaged in a trajectory (2; 32) on the outside of the spherical support element (1; 31), the trajectory (2; 32) defining a plurality of predetermined positions on the outside of the spherical support element (1; 31) between which the puzzle elements (16; 33) are movable, the predetermined positions being formed by the corners of a regular dodecahedron, characterised in that the spherical support element (1; 31) comprises a core and a plurality of trajectory forming elements (15; 45-46) which form the trajectory (2; 32), the trajectory forming elements (15; 45-46) being fixed onto the core (13; 43-44) by a first snap-fitting arrangement (40-41);

in that the movable puzzle elements (16; 33) each comprise a top part (19; 49) for forming the outer surface of the puzzle and a bottom part (21; 50) for engaging in the trajectory (2; 32), the top and bottom parts being fixed to each other by a second snap-fitting arrangement (51-52);

and in that the puzzle further comprises at least one removable puzzle element (17; 34) which is removably mountable on all of said plurality of predetermined positions for providing an empty position when removed and for fixing the position of the movable puzzle elements when mounted.

2. Ball-shaped puzzle according to claim 1, characterised in that the trajectory forming elements (45-46) and the core (43-44) are provided with orientation locking members (42), which have complementary shapes and are provided for fixing the orientation of the trajectory forming elements (45-46) once fitted on the core (43-44).

3. Ball-shaped puzzle according to claim 1, characterised in that the first snap-fitting arrangement (40-41) comprises a fixing member (41) on the trajectory forming elements (45-46) and a complementary opening (40) in the core (43-44) for accommodating the fixing member.

4. Ball-shaped puzzle according to claim 3, characterised in that the core (43-44) is constructed as two matching halves, the openings (40) in each of the halves all extending substantially in the same direction.

5. Ball-shaped puzzle according to claim 1, characterised in that the shape of each trajectory forming elements (45-46) is adapted to one or more possible locations on the core (43-44) where it can be fitted.

6. Ball-shaped puzzle according to claim 1, characterised in that the movable puzzle elements (16; 33) take up a given space during movement between any two of said predetermined positions, the spherical support element (1; 31) being fully composed of parts which are fixed with respect to each other and which are all located outside said space.

7. Ball-shaped puzzle according to claim 1, characterised in that the movable puzzle elements (33) cover substantially the whole spherical support element (31).

8. Ball-shaped puzzle according to claim 7, characterised in that the movable puzzle elements (33) have a substantially triangular top surface.

9. Ball-shaped puzzle according to claim 1, characterised in that the spherical support element (1) has parts which are uncovered by the movable puzzle elements (16), the uncovered parts forming fixed puzzle elements (15).

10. Ball-shaped puzzle according to claim 9, characterised in that the movable puzzle elements (16) mainly extend in a first spherical plane and the fixed puzzle elements (15) mainly extend in a second, concentric spherical plane, the first and second spherical planes showing a predetermined difference in diameter for enabling the movable puzzle elements to pass by the fixed puzzle elements upon movement from one predetermined position to another.

11. Ball-shaped puzzle according to claim 10, characterised in that the fixed puzzle elements (15) are countersunk with respect to the movable puzzle elements (16).

12. Ball-shaped puzzle according to claim 9, characterised in that the movable puzzle elements (16) have a regular hexagonal shape and the uncovered parts of the fixed puzzle elements (15) have a regular pentagonal shape.

* * * * *